US006546748B1

(12) United States Patent
Kelly et al.

(10) Patent No.: US 6,546,748 B1
(45) Date of Patent: Apr. 15, 2003

(54) CRYOGENIC RECTIFICATION SYSTEM FOR PRODUCING ULTRA HIGH PURITY CLEAN DRY AIR

(75) Inventors: Richard Martin Kelly, Buffalo, NY (US); Thomas John Bergman, Jr., Clarence Center, NY (US)

(73) Assignee: Praxair Technology, Inc., Danbury, CT (US)

( * ) Notice: Subject to any disclaimer, the term of this patent is extended or adjusted under 35 U.S.C. 154(b) by 0 days.

(21) Appl. No.: 10/166,361

(22) Filed: Jun. 11, 2002

(51) Int. Cl.[7] ..... F25J 3/00
(52) U.S. Cl. ..... 62/654; 62/643
(58) Field of Search ..... 62/643, 653, 654, 62/648, 50.2, 646

(56) References Cited

U.S. PATENT DOCUMENTS

| | | | | |
|---|---|---|---|---|
| 4,848,996 | A | 7/1989 | Thorogood et al. | 62/39 |
| 4,927,441 | A | 5/1990 | Agrawal | 62/28 |
| 5,098,457 | A | 3/1992 | Cheung et al. | 62/24 |
| 5,546,765 | A | 8/1996 | Nagamura et al. | 62/643 |
| 6,151,914 | A | 11/2000 | Mizuno et al. | 62/648 |
| 6,221,323 | B1 | 4/2001 | Mizuno et al. | 423/210 |
| 2001/0052243 | A1 * | 12/2001 | Davidian | 62/643 |
| 2002/0095951 | A1 * | 7/2002 | Ha | 62/643 |

* cited by examiner

*Primary Examiner*—William C. Doerrler
(74) *Attorney, Agent, or Firm*—Stanley Ktorides

(57) ABSTRACT

A cryogenic rectification system wherein feed air is provided into the lower portion of a cryogenic rectification column, and liquid having a defined oxygen concentration is withdrawn from a defined intermediate level of the column above the feed air introduction level, vaporized and optionally diluted with nitrogen for recovery as ultra high purity clean dry air.

10 Claims, 1 Drawing Sheet

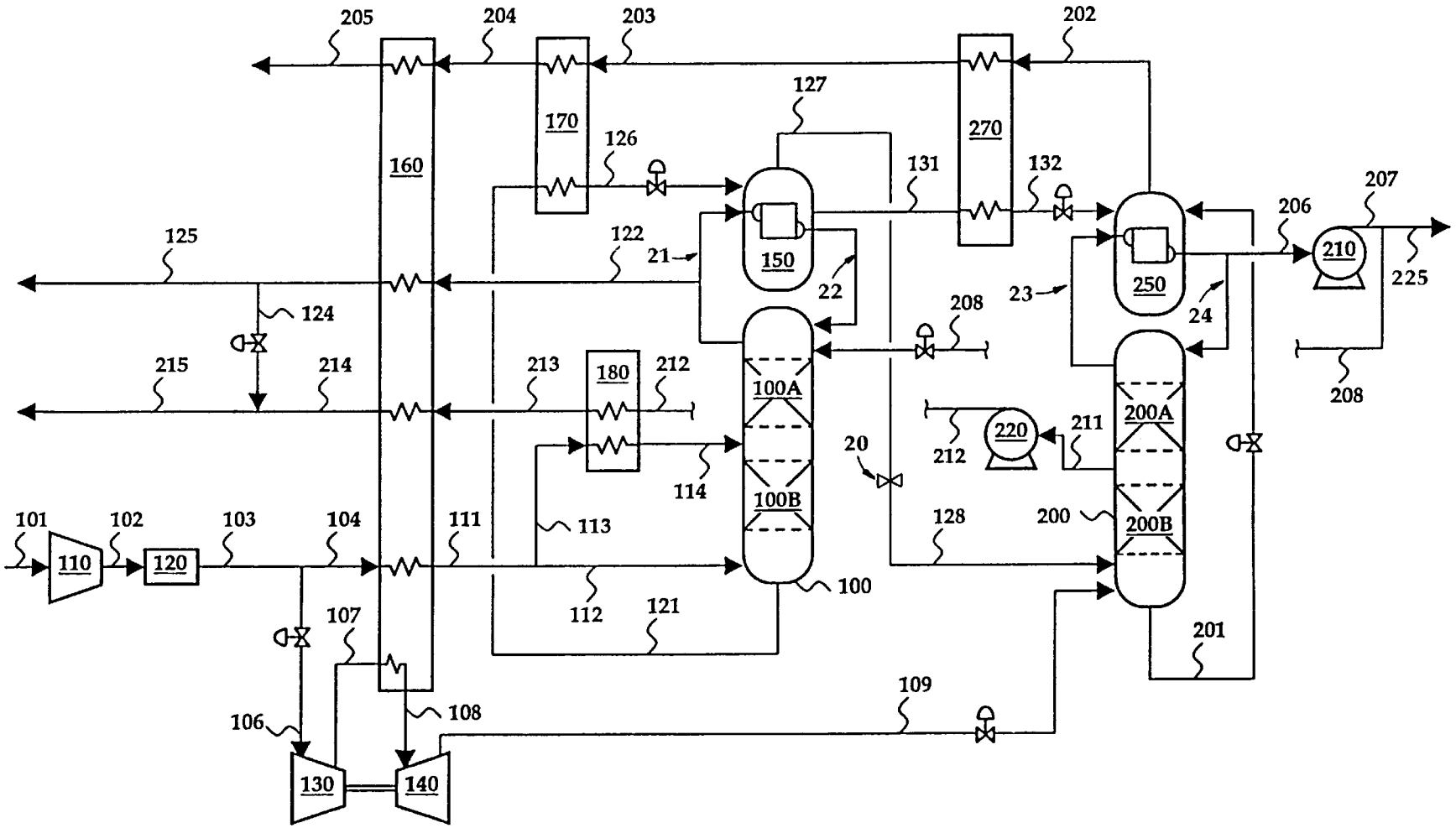
101
102
103
104
105
106
107
108
109
110
111
112
113
114
120
121
122
123
124
125
126
127
128
130
131
132
140
150
160
170
180
200
200A
200B
201
202
203
204
205
206
207
208
210
211
212
213
214
215
220
225
250
270
100
100A
100B
20
21
22
23
24

CRYOGENIC RECTIFICATION SYSTEM FOR PRODUCING ULTRA HIGH PURITY CLEAN DRY AIR

TECHNICAL FIELD

This invention relates generally to the cryogenic rectification of air and is particularly useful for the production of ultra high purity clean dry air.

BACKGROUND ART

Clean dry air is used as a utility fluid in manufacturing processes. For example, clean dry air is used in the manufacture of semiconductors in such applications as pneumatic valve actuation, for driving small motors and for cleaning equipment parts.

In the cryogenic separation of air to produce nitrogen and certain other pure gases which may be used in semiconductor manufacturing operations, air is first cleaned of high boiling impurities such as carbon dioxide and water vapor prior to being passed into the column or columns of the cryogenic air separation plant. Clean dry air is taken from this cleaned feed to the cryogenic air separation plant for use in the semiconductor manufacturing operation.

Recently several new applications have emerged where clean dry air is used directly in the semiconductor manufacturing equipment. Examples of such new applications include the use of clean dry air as a sweep gas to prevent build up of unwanted contaminants, and the use of clean dry air as a coolant to remove heat from the equipment. Clean dry air for these applications is required at a much higher purity than was previously needed.

Accordingly it is an object of this invention to provide an improved system for producing clean dry air.

It is another object of this invention to provide a system which can effectively produce clean dry air having an ultra high purity.

SUMMARY OF THE INVENTION

The above and other objects, which will become apparent to those skilled in the art upon a reading of this disclosure, are attained by the present invention, one aspect of which is:

A method for producing ultra high purity clean dry air comprising:

(A) passing feed air at a feed air level into a cryogenic rectification column and producing by cryogenic rectification within the column a nitrogen-rich fluid and an oxygen-enriched fluid;

(B) withdrawing nitrogen-rich fluid from the upper portion of the column, and withdrawing oxygen-enriched fluid from the lower portion of the column;

(C) withdrawing liquid having an oxygen concentration within the range of from 10 to 50 mole percent from the column at a withdrawal level which is within the range of from 1 to 25 equilibrium stages above the feed air level; and (D) vaporizing the withdrawn liquid and recovering the resulting vapor as ultra high purity clean dry air.

Another aspect of the invention is:

Apparatus for producing ultra high purity clean dry air comprising:

(A) a heat exchanger, a cryogenic rectification column, and means for passing feed air into the cryogenic rectification column at a feed air level;

(B) means for withdrawing fluid from the upper portion of the cryogenic rectification column, and means for withdrawing fluid from the lower portion of the cryogenic rectification column;

(C) means for passing liquid withdrawn from the cryogenic rectification column at a level within the range of from 1 to 25 equilibrium stages above the feed air level to the heat exchanger; and (D) means for recovering ultra high purity clean dry air from the heat exchanger.

As used herein the term "feed air" means a mixture comprising primarily oxygen and nitrogen, such as ambient air.

As used herein the term "column" means a distillation or fractionation column or zone, i.e. a contacting column or zone, wherein liquid and vapor phases are countercurrently contacted to effect separation of a fluid mixture, as for example, by contacting of the vapor and liquid phases on a series of vertically spaced trays or plates mounted within the column and/or on packing elements such as structured or random packing. For a further discussion of distillation columns, see the Chemical Engineer's Handbook, fifth edition, edited by R. H. Perry and C. H. Chilton, McGraw-Hill Book Company, New York, Section 13, *The Continuous Distillation Process.*

Vapor and liquid contacting separation processes depend on the difference in vapor pressures for the components. The high vapor pressure (or more volatile or low boiling) component will tend to concentrate in the vapor phase whereas the low vapor pressure (or less volatile or high boiling) component will tend to concentrate in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases is generally adiabatic and can include integral (stagewise) or differential (continuous) contact between the phases. Separation process arrangements that utilize the principles of rectification to separate mixtures are often interchangeably termed rectification columns, distillation columns, or fractionation columns. Cryogenic rectification is a rectification process carried out at least in part at temperatures at or below 150 degrees Kelvin (K).

As used herein the term "indirect heat exchange" means the bringing of two fluids into heat exchange relation without any physical contact or intermixing of the fluids with each other.

As used herein the term "top condenser" means a heat exchange device that generates column downflow liquid from column vapor.

As used herein the terms "turboexpansion" and "turboexpander" mean respectively method and apparatus for the flow of high pressure gas through a turbine to reduce the pressure and the temperature of the gas thereby generating refrigeration.

As used herein the term "subcooling" means cooling a liquid to be at a temperature lower than the saturation temperature of that liquid for the existing pressure.

As used herein the term "top" when referring to a column means that section of the column above the column mass transfer internals, i.e. trays or packing.

As used herein the term "bottom" when referring to a column means that section of the column below the column mass transfer internals, i.e. trays or packing.

As used herein the term "ultra high purity clean dry air" means a fluid which comprises from 10 to 50 mole percent oxygen with the balance comprised essentially of nitrogen and containing a total of less than 10,000 parts per billion (ppb), more preferably less than 100 ppb, most preferably less than 10 ppb of hydrogen, carbon monoxide, water, carbon dioxide and hydrocarbon impurities.

As used herein the term "tray" means a contacting stage, which is not necessarily an equilibrium stage, and may mean other contacting apparatus such as packing having a separation capability equivalent to one tray.

As used herein the term "equilibrium stage" means a vapor-liquid contacting stage whereby the vapor and liquid leaving the stage are in mass transfer equilibrium, e.g. a tray having 100 percent efficiency or a packing element height equivalent to one theoretical plate (HETP).

As used herein the terms "upper portion" and "lower portion" mean those sections of a column respectively above and below the mid point of the column.

As used herein the term "high purity nitrogen" means a fluid having a nitrogen concentration of at least 99 mole percent, preferably at least 99.9 mole percent, most preferably at least 99.999 mole percent. A particularly desirable form of high purity nitrogen is ultra high purity nitrogen which is a fluid having a nitrogen concentration of at least 99.99999 mole percent.

BRIEF DESCRIPTION OF THE DRAWING

The sole FIGURE is a simplified schematic representation of one preferred embodiment of the cryogenic rectification system of this invention for producing ultra high purity clean dry air which also produces ultra high purity nitrogen.

DETAILED DESCRIPTION

In general, the invention is a system for cogenerating ultra high purity clean dry air from a system for the generation of high purity nitrogen, preferably ultra high purity nitrogen. The system for generating high purity nitrogen broadly comprises compression and purification processes, carried out at around ambient temperature or above, and a cryogenic rectification process, carried out at least in part, below 150 K. The cryogenic rectification process comprises at least one rectification column where ultra high purity nitrogen is produced as a top product and where argon and oxygen and other impurities that are heavier than nitrogen, are rejected as a bottom waste stream. The invention takes liquid from a point in the rectification column where the oxygen concentration is within the range of from 10 to 50 mole percent, preferably from 15 to 30 mole percent, most preferably from 19.5 to 23.5 mole percent and where most of the impurities that are heavier than nitrogen and oxygen have been separated. This liquid is then pumped to an elevated pressure determined by the ultimate clean dry air product pressure, vaporized and the resulting vapor warmed. The concentration of oxygen in the extracted stream is measured, and if it is found to be greater than a certain predetermined level, ultra high purity nitrogen product is added to the stream to dilute it. The final stream is recovered as ultra high purity clean dry air product.

The invention will be described in greater detail with reference to the Drawing. Referring now to the FIGURE, feed air stream 101 is taken from the atmosphere, filtered and compressed in compressor 110 to a pressure generally within the range of from 150 to 250 pounds per square inch absolute (psia) to form compressed air stream 102. Compressor 110 commonly comprises a number of compressor stages in series with heat of compression being removed from the air stream in between each stage in inter-coolers, and after the last stage, in an after-cooler. The inter-coolers and the after-cooler also drain any water that might be condensed from the air stream.

Stream 102 is then passed through prepurifier unit 120 which removes several atmospheric impurities that are not desired in the final ultra high purity nitrogen product and that might also freeze out at subsequent cryogenic temperatures. The prepurifer unit commonly includes a catalytic reactor that is used to oxidize hydrogen and carbon monoxide gases into moisture and carbon dioxide respectively. Hydrogen has a boiling point significantly above that of nitrogen and without removal, would otherwise pass to the ultra high purity nitrogen product in the subsequent cryogenic rectification process. Carbon monoxide has a boiling point below nitrogen but above oxygen, and without removal, would also appear in part in the ultra high purity nitrogen product. The prepurifier unit also includes an adsorption system to substantially remove moisture and carbon dioxide from the air stream. This moisture and carbon dioxide comprises that already present in the feed air and that which is formed in the catalytic reactor. The adsorption unit removes moisture and carbon dioxide to a level somewhat less than 1 ppm v/v, most typically <0.1 ppm v/v and <0.25 ppm v/v respectively. At this level, these gases will not rapidly build up as frozen deposits in the cryogenic apparatus. Further, since their boiling points are significantly less than that of nitrogen, argon and oxygen, these impurities will not accumulate in the ultra high purity nitrogen product, but rather they will pass out of the process in a waste stream. Other impurities, apart from hydrogen, carbon monoxide, moisture and carbon dioxide, are also present in the air stream, and include hydrocarbon species such as methane and ethane. These hydrocarbons are not appreciably oxidized in the catalytic reactor at the usual operating temperatures of between approximately 300 and 500° F., and are not appreciably adsorbed in the adsorption unit and therefore pass, at least in part, through the prepurifier unit. Methane is the lightest atmospheric hydrocarbon and has a boiling point below nitrogen, argon and oxygen. It and other heavier impurities can therefore easily be separated from the ultra high purity nitrogen product by cryogenic rectification and pass with the argon and oxygen components into a waste stream.

Prepurified air stream 103 exits the prepurifier and is split into main air stream 104 and turbine air stream 106. Stream 104 enters the cryogenic rectification cycle and is first cooled in heat exchanger 160, from around ambient temperature, to a point close to the dew point of air. Stream 106 is further compressed in compressor 130 to form stream 107, and is then also passed into heat exchanger 160. Stream 107 is cooled to a temperature somewhat above it's liquefying point and then extracted from heat exchanger 160 as stream 108. Stream 108 is then expanded to a lower pressure in turboexpander 140 to form first low pressure column feed stream 109. Expansion across turbine 140 causes stream 108 to cool and generate refrigeration for the cryogenic rectification cycle. The amount of refrigeration generated is controlled by the proportion of stream 103 passing to stream 106, and is commonly in the range of from 5 to 20%. Compressor 130 and turbine 140 are commonly linked by a drive shaft, which removes work from the turbine and supplies that work to the compressor. This arrangement increases the refrigeration that is achieved by the turbine, since it boosts the pressure of stream 106 prior to expansion. It is not necessary however, and indeed compressor 130 may be omitted and the work generated by the turbine may be removed by some other means, for example an oil brake, or other friction coupling.

Stream 104 emerges from heat exchanger 160 as stream 111 and is split into streams 112 and 113. Higher pressure column 100 is operating at a pressure generally within the range of from 130 to 230 psia and contains an upper rectification section 100A and a lower rectification section 100B. Stream 112 passes directly into column 100, below section 100B. Stream 113 passes into heat exchanger 180, where it is cooled and at least partially condensed by indirect heat exchange with stream 212, which is a liquid stream derived from rectification column 200. Stream 113 exits heat exchanger 180 as stream 114 and is passed into column 100 at a point above section 100B and below section 100A. At this point, the composition of the condensed portion of stream 114 approximately matches the concentration of the liquid passing from the bottom of section 100A into the top of section 100B.

Gaseous stream 112 ascends column 100 and contacts a descending liquid stream that is rich in the heavier components of air. The counter-current contacting that occurs causes light components of air, i.e. nitrogen, to concentrate in the ascending gas stream and heavy components of air such as oxygen and argon to concentrate in the descending liquid stream by cryogenic rectification. Liquid that reaches the bottom of column 100 is removed as high pressure column waste stream 121. A first portion of the gas that reaches the top of the column passes in stream 21 into the condensing-side passages of higher pressure column top condenser 150 where it is condensed and returned to the top of column 100, above section 100A, as reflux liquid in stream 22. A second portion of the gas stream is taken as ultra high purity gaseous nitrogen stream 122, and is then warmed back up to close to ambient temperature in heat exchanger 160 to form ultra high purity gaseous nitrogen product stream 125.

Condenser 150 cooling duty is derived from stream 121, which exits the bottom of column 100. This stream is sub-cooled by a few degrees in heat exchanger 170 to form stream 126 and then passed into the boiling-side passages of condenser 150, in indirect heat exchange relation to the condensing vapor in the condensing-side passages. The pressure in the boiling-side passages is significantly lower than the pressure of stream 126 and set such that the boiling point of the boiling-side liquid is sufficiently less than the boiling point of the condensing-side vapor, so as to achieve the necessary indirect heat exchange. Vapor formed in the boiling-side, exits condenser 150 as stream 127, while any remaining liquid in the boiling-side, exits as stream 131. In addition to the column reflux generated in the condensing-side of condenser 150, additional reflux is added in the form of returned high pressure liquid nitrogen stream 208, which is generated in lower pressure column 200.

Stream 127 exits condenser 150 and is throttled across valve 20 to form second lower pressure column feed stream 128. Column 200 is operating at a pressure less than that of column 100 and generally within the range of from 50 to 100 psia. Lower pressure column 200 contains upper rectification section 200A and a lower rectification section 200B. Stream 128 and stream 109 enter the bottom of lower pressure column 200 below section 200B. The gaseous stream, ascending column 200 contacts a descending liquid stream that is rich in the heavier components of air. The counter-current contacting that occurs, causes light components of air, i.e. nitrogen, to concentrate in the ascending gas stream and heavy components of air such as oxygen and argon to concentrate in the descending liquid stream by cryogenic rectification. Liquid that reaches the bottom of the column is removed as lower pressure column waste stream 201. The gas that reaches the top of the column passes in stream 23 into the condensing-side passages of lower pressure top column condenser 250 where it is condensed. A first portion of the liquid is returned to the top of column 200 as reflux liquid in stream 24. A second portion of the liquid is taken from condenser 250 as liquid nitrogen stream 206. Stream 206 is pumped in pump 210 to a pressure in excess of the operating pressure of higher pressure column 100, to form high pressure liquid nitrogen stream 207. A first portion of stream 207 is taken as returned high pressure liquid nitrogen stream 208 and passed into the top of column 100 as additional reflux. A second portion of stream 207 may be taken as ultra high purity liquid nitrogen product stream 225.

A second liquid stream 211, is taken from lower pressure column 200 and is used to produce an ultra high purity clean dry air product. Stream 211 is extracted between rectification sections 200A and 200B at a level such that stream 211 has an oxygen concentration within the range of from 10 to 50 mole percent. This level is within the range of from 1 to 25 equilibrium stages, preferably from 5 to 20 equilibrium stages, above the feed level where feed stream 109 is passed into the column. The oxygen concentration of the liquid withdrawn in stream 211 is preferably within the range of from 15 to 30 mole percent, most preferably within the range of from 19.5 to 23.5 mole percent. The withdrawal level also corresponds to a position where heavy atmospheric impurities, such as methane and ethane, have been substantially separated. These impurities being heavier than oxygen, concentrate in section 200B and pass out of the bottom of column 200 in stream 201. Stream 211 is a liquid air-like stream that may be enriched in oxygen and is substantially depleted in heavy impurities. Stream 211 may then be pumped, if desired, to an elevated pressure by pump 220 to form stream 212, the pressure of stream 212 being sufficient to provide an ultimate ultra high purity clean dry air product at the required product pressure. Stream 212 is then passed through heat exchanger 180, where it is at least partially vaporized by indirect heat exchange with stream 113. Generally the required delivery pressure of the final clean dry air product is sufficiently lower than the required delivery pressure of the final gaseous nitrogen product. This means that stream 113 has a boiling point sufficiently higher than that of stream 212, and therefore the necessary temperature difference is available to promote indirect heat exchange between the two streams in heat exchanger 180. Further, the flow of stream 113 can be easily adjusted to match the required heat load necessary to at least partially vaporize stream 212. Stream 213 exits heat exchanger 180, at least partially vaporized, and passes into heat exchanger 160 where any remaining liquid is vaporized, and where the vapor is warmed up to around ambient temperature to form ultra high purity clean dry air stream 214 which may be recovered as product. As already mentioned stream 214 has an oxygen concentration generally corresponding to that of air. Accordingly, stream 124, which comprises ultra high purity nitrogen, may be added to stream 214 in order to dilute stream 214, and make the oxygen concentration equal to that of atmospheric air, or at least within desired limits. The resulting stream is ultra high purity clean dry air product stream 215. The pressure of stream 214 must be below that of stream 124, in order for stream 124 to be added to stream 214.

Top condenser 250 cooling duty is derived from stream 201, which exits the bottom of column 200, and stream 131, which exits the boiling-side of top condenser 150. Stream

201 is passed into the boiling-side passages of condenser 250. Stream 131 is subcooled by a few degrees in heat exchanger to 270 to form stream 132, and then stream 132 is also passed into the same boiling side passages of condenser 250. The boiling-side liquid formed from streams 201 and 132 is positioned in indirect heat transfer relation to the condensing vapor in the condensing-side passages of condenser 250. The pressure in the boiling-side passages is significantly lower than the pressure of streams 132 and 201 and set such that the boiling point of the boiling-side liquid is sufficiently less than the boiling point of the condensing-side vapor so as to achieve the necessary indirect heat transfer. Vapor formed in the boiling-side of condenser 250, exits the condenser as stream 202 and is warmed up in heat exchanger 270 to form stream 203, which is further warmed up in heat exchanger 170 to form stream 204, which is still further warmed up to around ambient temperature in heat exchanger 160 to form waste stream 205. A portion of stream 205 is commonly used as regenerating sweep gas for the adsorption system in prepurifier 120, while the remaining portion is commonly vented to atmosphere.

A number of computer simulations were carried out to demonstrate the invention and the advantages attainable thereby and the results are presented in Table 1.

Table 1 lists the expected concentration of several impurities in (A) ultra high purity clean dry air product from the preferred embodiment of the invention, where the product is derived from air-like liquid taken from the lower pressure column of a dual column cycle such as is illustrated in the Figure; (B) clean dry air product from an alternative embodiment of the invention, where the product is derived from air-like liquid taken from the higher pressure column of such dual column cycle; (C) a conventional system, where clean dry air is taken from the prepurifier unit, and (D) atmospheric air. Table 1 shows that all of these heavy impurities are removed to below ppb levels in the preferred embodiment, and that all, except methane are removed to below ppb levels in the alternative embodiment, methane being reduced to approximately 200 ppb. Clean dry air produced by the conventional system however, contains significant amounts of these heavy impurities. Hydrogen and carbon monoxide are removed to below ppb levels, but methane and ethane pass through the prepurifier and remain at their atmospheric concentrations, while moisture and carbon dioxide are still at relatively high levels. In Table 1 all concentrations are reported in ppm mol/mol.

TABLE 1

| Impurity | A | B | C | D |
|---|---|---|---|---|
| Hydrogen ($H_2$) | <0.001 | <0.001 | <0.001 | 0.5 |
| Carbon Monoxide (CO) | <0.001 | <0.001 | <0.001 | 0.5 |
| Methane ($CH_4$) | <0.001 | 0.2 | 1 | 1 |
| Ethane ($C_2H_6$) | <0.001 | <0.001 | 0.05 | 0.05 |
| Carbon Dioxide ($CO_2$) | <0.001 | <0.001 | <0.25 | 350 |
| Moisture ($H_2O$) | <0.001 | <0.001 | <0.1 | 1000 to 28,000 |

Although the invention has been discussed in detail with reference to certain preferred embodiments, those skilled in the art will recognize that there are other embodiments of the invention within the spirit and the scope of the claims. For example, the invention may be practiced with a single column cryogenic air separation plant and also with a cryogenic air separation plant having more than two columns.

What is claimed is:

1. A method for producing ultra high purity clean dry air comprising:

(A) passing feed air at a feed air level into a cryogenic rectification column and producing by cryogenic rectification within the column a nitrogen-rich fluid and an oxygen-enriched fluid;

(B) withdrawing nitrogen-rich fluid from the upper portion of the column, and withdrawing oxygen-enriched fluid from the lower portion of the column;

(C) withdrawing liquid having an oxygen concentration within the range of from 10 to 50 mole percent from the column at a withdrawal level which is within the range of from 1 to 25 equilibrium stages above the feed air level; and (D) vaporizing the withdrawn liquid and recovering the resulting vapor as ultra high purity clean dry air.

2. The method of claim 1 wherein the nitrogen-rich fluid withdrawn from the upper portion of the column is recovered as ultra high purity nitrogen product.

3. The method of claim 1 wherein the liquid withdrawn from the column is increased in pressure prior to being vaporized.

4. The method of claim 1 further comprising passing nitrogen into the vaporized withdrawn liquid to reduce the oxygen concentration of the vaporized withdrawn liquid prior to recovery as ultra high purity clean dry air.

5. The method of claim 1 further comprising passing feed air into a higher pressure column having a top condenser and passing fluid from the top condenser of the higher pressure column into the cryogenic rectification column.

6. Apparatus for producing ultra high purity clean dry air comprising:

(A) a heat exchanger, a cryogenic rectification column, and means for passing feed air into the cryogenic rectification column at a feed air level;

(B) means for withdrawing fluid from the upper portion of the cryogenic rectification column, and means for withdrawing fluid from the lower portion of the cryogenic rectification column;

(C) means for passing liquid withdrawn from the cryogenic rectification column at a level within the range of from 1 to 25 equilibrium stages above the feed air level to the heat exchanger; and (D) means for recovering ultra high purity clean dry air from the heat exchanger.

7. The apparatus of claim 6 wherein the means for passing the liquid withdrawn from the cryogenic rectification column to the heat exchanger includes a liquid pump.

8. The apparatus of claim 6 further comprising a higher pressure column having a top condenser, and means for passing fluid from the top condenser to the cryogenic rectification column.

9. The apparatus of claim 8 further comprising means for recovering fluid from the upper portion of the higher pressure column.

10. The apparatus of claim 8 further comprising means for passing fluid from the upper portion of the higher pressure column to the means for recovering ultra high purity clean dry air from the heat exchanger.

* * * * *